US009850683B2

(12) United States Patent
Knudsen

(10) Patent No.: US 9,850,683 B2
(45) Date of Patent: Dec. 26, 2017

(54) POST CAPS

(71) Applicant: N. Eric Knudsen, Maple Valley, WA (US)

(72) Inventor: N. Eric Knudsen, Maple Valley, WA (US)

( * ) Notice: Subject to any disclaimer, the term of this patent is extended or adjusted under 35 U.S.C. 154(b) by 264 days.

(21) Appl. No.: 14/464,564

(22) Filed: Aug. 20, 2014

(65) Prior Publication Data

US 2015/0053905 A1 Feb. 26, 2015

Related U.S. Application Data

(60) Provisional application No. 61/868,026, filed on Aug. 20, 2013.

(51) Int. Cl.
*E04H 17/00* (2006.01)

(52) U.S. Cl.
CPC ..... *E04H 17/00* (2013.01); *E04H 2017/006* (2013.01); *Y10T 29/49817* (2015.01); *Y10T 29/49826* (2015.01)

(58) Field of Classification Search
CPC . E04H 2017/006; E04H 17/20; Y10S 256/05; E04C 5/161
USPC ..... 256/1; 52/300, 301, 311.1; D25/133, D25/135
See application file for complete search history.

(56) References Cited

U.S. PATENT DOCUMENTS

D239,452 S * 4/1976 Russo ..... A61J 9/00 52/301
3,970,206 A * 7/1976 Morash ..... A61J 9/00 206/503
4,103,875 A * 8/1978 Glass ..... E04H 17/003 256/59
4,936,472 A * 6/1990 Meier ..... F16B 5/00 211/194
5,030,029 A * 7/1991 Johnsen ..... E01F 13/02 116/202
5,634,555 A * 6/1997 Dunham ..... B65D 5/5059 206/19
5,927,694 A * 7/1999 Montepiano ..... E04H 12/2215 256/19
6,076,807 A * 6/2000 Spence ..... E04H 17/1413 256/1
6,138,422 A * 10/2000 Wall ..... E04H 12/2292 52/300
6,513,284 B1 * 2/2003 Sandlin ..... A01G 9/022 232/39
6,662,515 B2 * 12/2003 Buhrts ..... E04H 17/20 256/1
6,745,759 B2 * 6/2004 Bossier ..... F24C 1/10 126/92 AC
D509,603 S 9/2005 Rosian
6,994,327 B2 2/2006 Steffes
(Continued)

*Primary Examiner* — Abigail Troy
*Assistant Examiner* — Nahid Amiri
(74) *Attorney, Agent, or Firm* — Seed IP Law Group LLP

(57) ABSTRACT

A post cap assembly for covering an upper end of a post is provided. The post cap assembly may include a post cap body having an internal post cavity that is sized and shaped to receive the upper end of the post and having a topper receiving aperture extending at least partially through the post cap body. An interchangeable topper may be positioned within the topper receiving aperture and projecting from the top side of the post cap body. Other post caps and related systems and methods are also provided.

14 Claims, 11 Drawing Sheets

(56) References Cited

U.S. PATENT DOCUMENTS

| | | | | |
|---|---|---|---|---|
| 7,021,016 | B2 * | 4/2006 | Steffes | E04H 17/20 256/1 |
| 7,143,556 | B2 * | 12/2006 | Hales | E04H 17/20 52/300 |
| D555,812 | S | 11/2007 | Speek | |
| 7,455,656 | B2 * | 11/2008 | Langeler | A61J 7/00 604/212 |
| D670,405 | S | 11/2012 | McKenzie | |
| D678,555 | S * | 3/2013 | Johnson | A61J 7/00 D25/135 |
| 8,844,907 | B1 * | 9/2014 | Davis | E04H 17/20 256/1 |
| D723,189 | S * | 2/2015 | Knudsen | A61J 7/00 D25/135 |
| D726,343 | S * | 4/2015 | Knudsen | A61J 7/00 D25/135 |
| 2003/0122115 | A1 * | 7/2003 | Ernst | E04H 17/20 256/1 |

* cited by examiner

POST CAPS

BACKGROUND

Technical Field

This disclosure generally relates to fence structures, and more particularly to post caps.

Description of the Related Art

Post caps are known which consist of a single, one-piece structure or a multi-piece structure, such as, for example, two post cap halves that may be fastened together to form a post cap. Example post caps are shown in U.S. Pat. No. 6,994,327. Such post caps, however, may suffer from a variety of drawbacks including poor durability, lack of versatility and/or inefficient space utilization.

BRIEF SUMMARY

Embodiments of the post caps described herein include robust form factors that may be stacked in a particularly efficient manner and provide enhanced versatility with respect to visual design elements thereof and/or with respect to installation of the post caps.

One embodiment of a post cap assembly for covering an upper end of a post may be summarized as including a post cap body having an internal post cavity that is sized and shaped to receive the upper end of the post and having a topper receiving aperture extending at least partially through the post cap body; and an interchangeable topper positioned within the topper receiving aperture and projecting from the top side of the post cap body. The interchangeable topper may include a decorative topper element that is configured to engage the topper receiving aperture with a snap fit or interference fit. The interchangeable topper may include a decorative topper element and a fastener to couple the interchangeable topper to the post cap body. In such instances, a threaded nut may be concealed within the decorative topper element to receive the fastener. The interchangeable topper may include a decorative topper element having a skirt portion that is shaped to nest with the top side of the post cap body. The skirt portion of the decorative topper element may be configured to divert rain water away from the topper receiving aperture. In some instances, the post cap body may be a single, one-piece body and may comprise cast concrete or injection molded plastic. The top side of the post cap body may be inclined downwardly away from a central apex, and, when a plurality of the post cap bodies are stacked, the central apex of a lower one of adjacent stacked post cap bodies may extend within the internal post cavity of an upper one of the adjacent stacked post cap bodies. In some instances, the topper receiving aperture may extend completely through the post cap body between the internal post cavity and the top side of the post cap body.

The post cap assembly may further include a post attachment device having one or more resilient coupling features removably engaged with a respective portion of the post cap body. The post attachment device may be readily separable from the post cap body for attachment to the upper end of the post apart from the post cap body. The post cap body may include at least one cavity that is sized and shaped to receive the at least one resilient coupling feature of the post attachment device. The at least one resilient coupling feature of the post attachment device may comprise a resilient tab that is sized, shaped and positioned to snap into the at least one cavity of the post cap body when the post cap body is urged into engagement with the post attachment device. The post attachment device may include a generally planar body with an array of apertures formed therein to receive fasteners for securing the post attachment device to an end face of the upper end of the post. The resilient coupling feature(s) of the post attachment device may project or extend downwardly from the generally planar body. The post attachment device may be sized to be insertably received and press fit within the internal post cavity of the post cap body. Each resilient coupling feature may be a resilient tab that is sized, shaped and positioned to flex in response to contact with a sidewall of the post cap body during insertion of the post attachment device into the internal post cavity of the post cap body. Another embodiment of a post cap assembly for covering an upper end of a post may be summarized as consisting of: a single, unitary post cap body having an internal post cavity that is sized and shaped to receive the upper end of the post and having a topper receiving aperture extending at least partially through the post cap body; and an interchangeable topper positioned within the topper receiving aperture and projecting from the top side of the post cap body.

Another embodiment of a post cap for covering an upper end of a post may be summarized as including a single, unitary body having an internal post cavity that is sized and shaped to receive the upper end of the post and having a partially spherical projection extending from a top side thereof. An outer maximum diameter of the partially spherical projection may be less than a maximum transverse dimension of the internal post cavity by no more than 0.50 inch, and in some instances, by no more than 0.25 inch. The internal post cavity may include a post receiving shoulder and a nesting portion adjacent thereto. The nesting portion may be shaped to nest with the partially spherical projection of an adjacent post cap when the post cap is stacked thereon and to assist in centering the post cap on the adjacent post cap.

According to another embodiment, an arrangement of post caps may be summarized as including a plurality of stacked post caps, each post cap having a single, unitary body with an internal post cavity that is sized and shaped to receive an upper end of a post and having a partially spherical projection extending from a top side thereof; and a plurality of liners, each liner positioned between a pair of adjacent post caps. The liner may have a lower portion configured to conceal an upper surface of a lower one of the pair of adjacent post caps. The liner may also have an upper portion configured to surround the partially spherical projection of the lower one of the pair of adjacent post caps and to prevent direct contact between the pair of adjacent post caps. The arrangement of post caps may further include a plurality of post attachment devices, each post attachment device being removably coupled to a respective one of the plurality of stacked post caps and being separable from the respective post cap for attachment to an upper end of a post apart from the post cap.

According to yet another embodiment, an arrangement of post caps may be summarized as including a plurality of stacked post caps, each post cap having a single, unitary body with an internal post cavity that is sized and shaped to receive an upper end of a post and having a tapered projection extending from a top side thereof; and a plurality of liners, each liner positioned between a pair of adjacent post caps. The liner may have a lower portion configured to conceal an upper surface of a lower one of the pair of adjacent post caps. The liner may also have an upper portion configured to surround an apex of the tapered projection of the lower one of the pair of adjacent post caps and to prevent direct contact between the pair of adjacent post caps. The arrangement of post caps may further include a plurality of post attachment devices, each post attachment device being removably coupled to a respective one of the plurality of stacked post caps and being separable from the respective post cap for attachment to an upper end of a post apart from the post cap.

According to yet another embodiment, a post cap assembly for installing on an upper end of a post may be summarized as including a post cap body having an internal post cavity that is sized and shaped to receive the upper end of the post and a post attachment device having at least one resilient coupling feature removably engaged with an engagement portion of the post cap body within the internal post cavity, the post attachment device being separable from the post cap body for attachment to the upper end of the post apart from the post cap body. The engagement portion of the post cap body may be a cavity that is sized and shaped to receive the at least one resilient coupling feature of the post attachment device. The at least one resilient coupling feature of the post attachment device may comprise a resilient tab that is sized, shaped and positioned to snap into the engagement portion of the post cap body when the post cap body is urged into engagement with the post attachment device. The post attachment device may include a generally planar body with an array of apertures formed therein to receive fasteners for securing the post attachment device to an end face of the upper end of the post. The post attachment device may be sized to be insertably received and press fit within the internal post cavity of the post cap body. The at least one resilient coupling feature of the post attachment device may comprise a resilient tab that is sized, shaped and positioned to flex in response to contact with a sidewall of the post cap body during insertion of the post attachment device into the internal post cavity of the post cap body.

According to yet another, a method of adorning a post with a post cap may be summarized as including coupling an interchangeable decorative topper element to a post cap base; and positioning the post cap base over the post such that an upper end of the post is received within a post receiving cavity thereof. The method may further include replacing the interchangeable decorative topper element with another different interchangeable decorative topper element. Coupling the interchangeable decorative topper element to the post cap base may include press-fitting or snap-fitting the decorative topper element within a topper receiving aperture formed in the post cap base. Coupling the interchangeable decorative topper element to the post cap base may include securing the decorative topper element to the post cap base with a fastener from within the post receiving cavity such that the fastener is concealed from view when the post cap base is positioned over the post. The method may further include, prior to positioning the post cap base over the post, securing a post attachment device to an upper end of the post and urging the post cap into engagement with the post attachment device.

Other aspects and features of the post caps and related systems and methods will be readily apparent to one of ordinary skill in the relevant art upon review of the drawings and detailed description.

DETAILED DESCRIPTION

Figure 1:
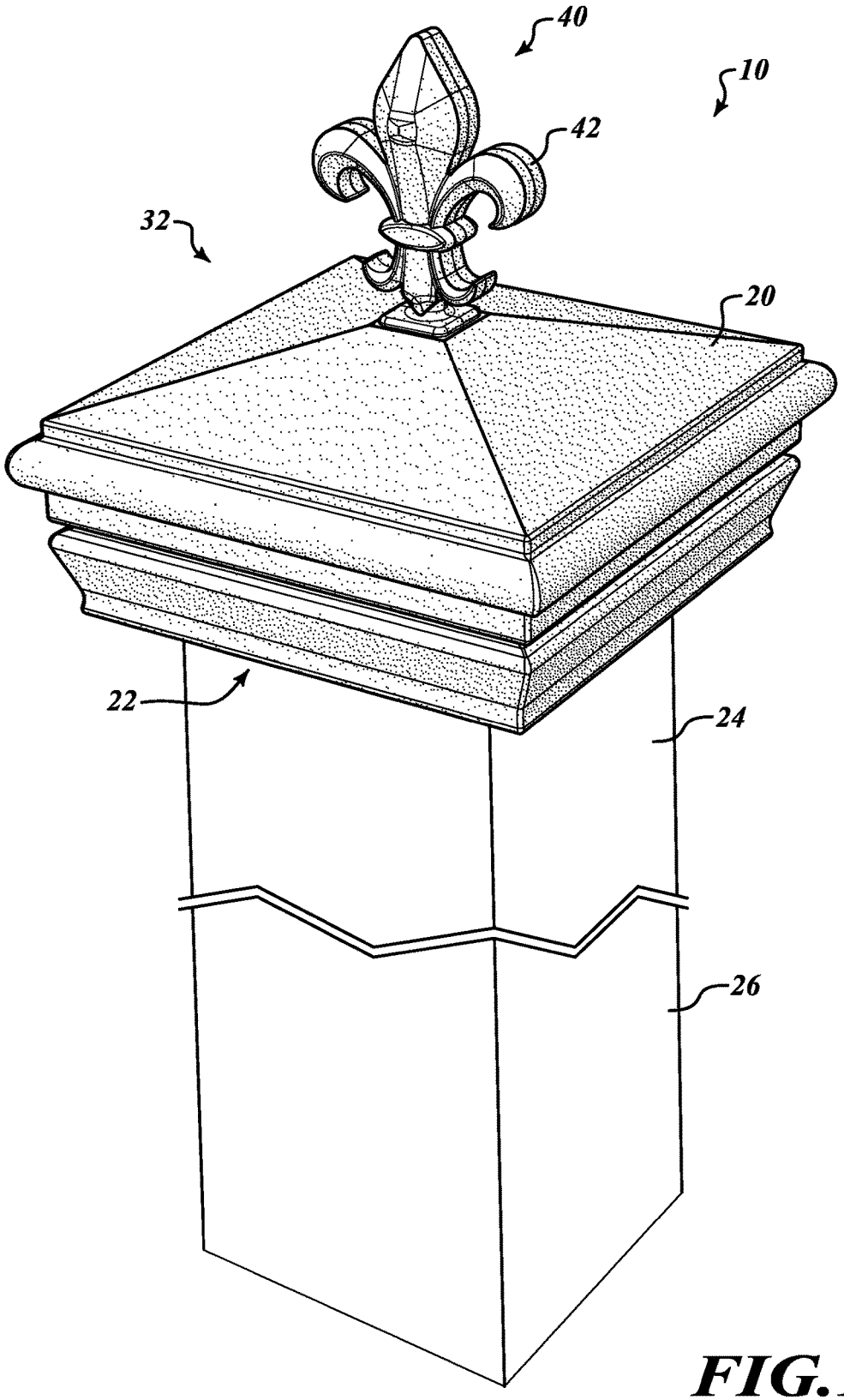
FIG. 1 is an isometric view of a post cap, according to one embodiment, installed on a post, such as, for example, a fence post.

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with fences, fence components and related accessories, such as post caps, have not been shown or described in detail to avoid unnecessarily obscuring descriptions of the embodiments. In addition, well-known structures and techniques associated with casting or molding processes have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

FIGS. 1 through 4 illustrate one embodiment of a post cap assembly 10 that includes a robust form factor, which may be stacked in a particularly efficient manner and which provides enhanced versatility with respect to visual appearance. The post cap assembly 10 includes a post cap body 20 and an interchangeable decorative topper 40 (e.g., a three dimensional fleur-de-lis, acorn, star, etc.).

The post cap body 20 has an internal post cavity 22 that is sized and shaped to receive an upper end 24 of a post 26. The internal post cavity 22 may be generally rectangular, cylindrical or otherwise shaped to substantially reflect a corresponding shape of the upper end 24 of the post 26 on which the post cap assembly 10 may be installed. The internal post cavity 22 may include sidewalls with a slight draft to facilitate release of the post cap body 20 from a mold when utilizing a casting or molding process to form the post cap body 20. A terminal end or shoulder portion of the internal post cavity 22 may define a stop against which an end surface of the post 26 may abut upon installation.

The post cap body 20 further includes a topper receiving aperture 30 that extends at least partially through the post cap body 20 and is configured to receive the interchangeable topper 40 with the topper 40 projecting from a top side 32 of the post cap body 20. In some instances, the topper receiving aperture 30 may extend completely through the post cap body 20 between the internal post cavity 22 and the top side 32 of the post cap body 20. In other instances, the topper receiving aperture 30 may be a blind hole.

The interchangeable topper 40 may be configured to engage the topper receiving aperture 30 with a snap fit or interference fit. In some instances, the interchangeable topper 40 may include a decorative topper element 42 and a fastener 44 (FIG. 2) to couple the interchangeable topper 40 to the post cap body 20. Additionally, a threaded nut 46 (FIG. 2) may be concealed within the decorative topper element 42 to receive the fastener 44. Alternatively, the topper element 42 may include internal threads to receive a corresponding fastener 44 or other coupling mechanisms, such as, for example, a detent mechanism, clips, snaps or other fastening devices. Preferably, the coupling mechanism of the interchangeable topper 40 is concealed from view upon installation into the topper receiving aperture 30.

Figure 2:
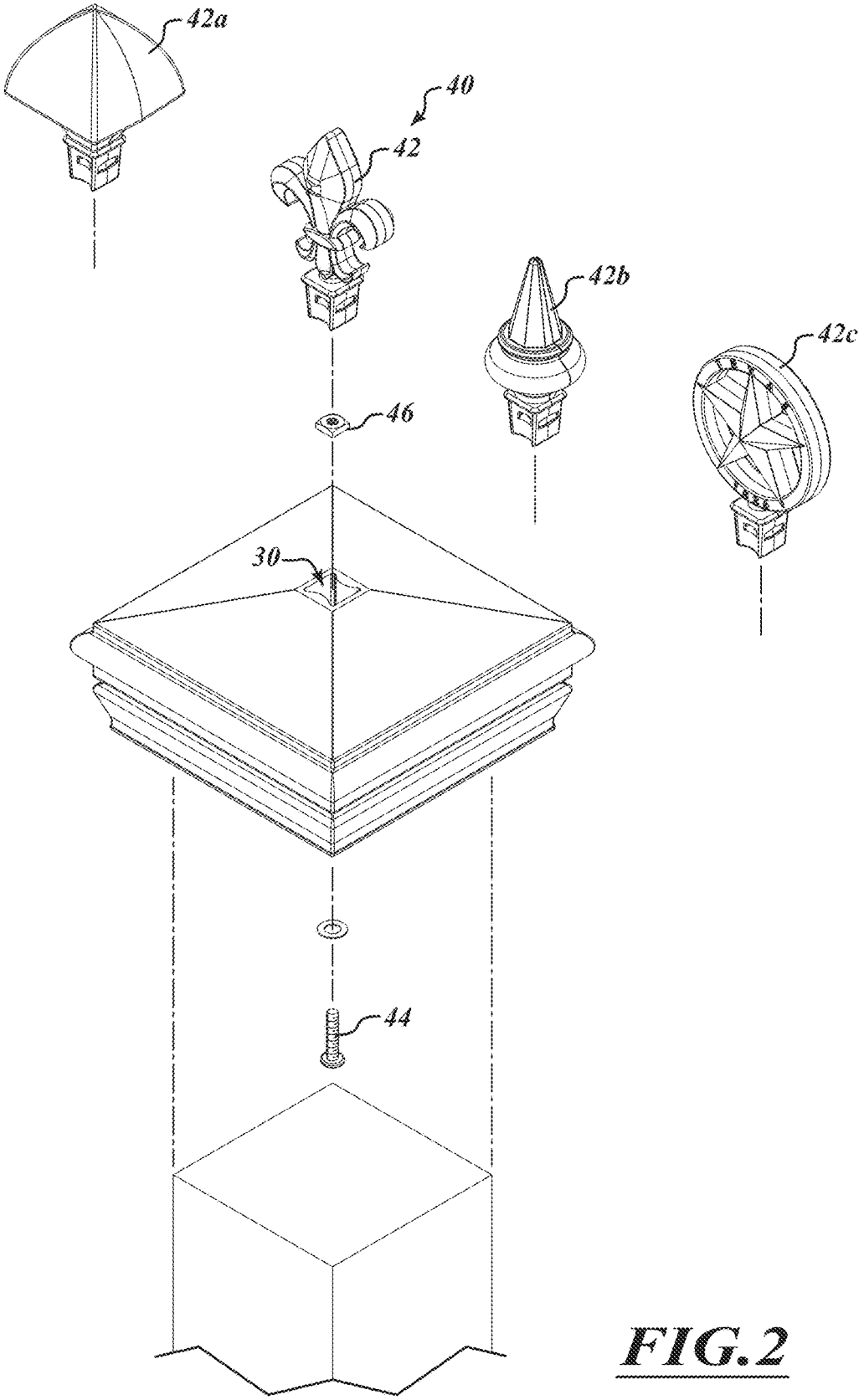
FIG. 2 is an isometric exploded view of the post cap of FIG. 1, together with a plurality of interchangeable topper elements.

In some embodiments, the interchangeable topper 40 may include a decorative topper element 42 having a skirt portion that is shaped to nest with the top side 32 of the post cap body 20. The skirt portion of the decorative topper element 42 may be configured to divert rain water away from the topper receiving aperture 30. The interchangeable topper 40 may include decorative topper elements 42 having a variety of forms. Some example decorative topper elements 42, 42*a*, 42*b*, 42*c* (collectively 42) are shown in FIG. 2. Other decorative topper elements 42 may include sport team emblems, cartoon characters, geometric shapes, or other design elements. The decorative topper elements 42 may be interchangeably replaced as needed or desired.

In some embodiments, the post cap body 20 is a single, one-piece body. In other instances, the post cap body 20 may be a multi-piece assembly. The post cap body 20 may be formed of cast concrete or injection molded plastic or other suitable materials.

Figure 3:
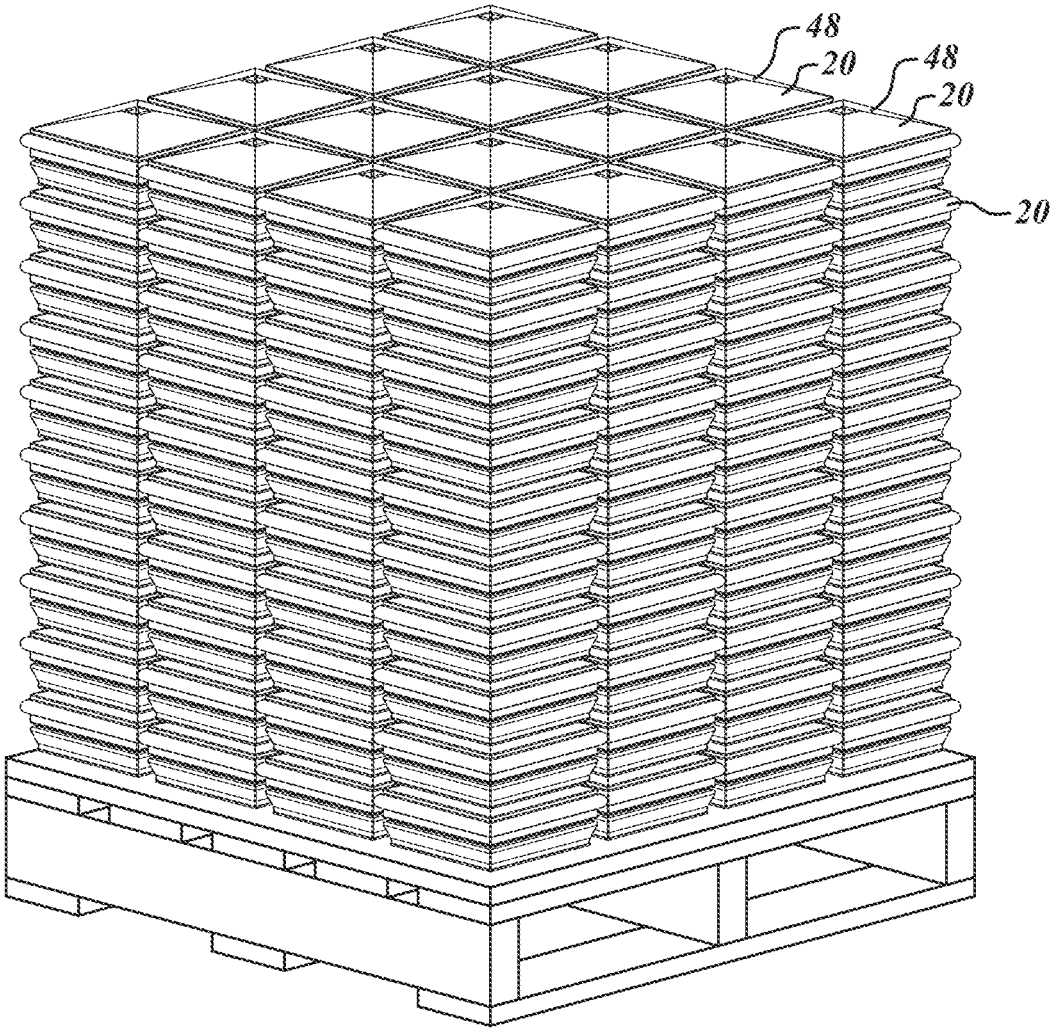
FIG. 3 is an isometric view of a plurality of the post caps of FIG. 1 stacked on a pallet for shipping or storage.
Figure 4:
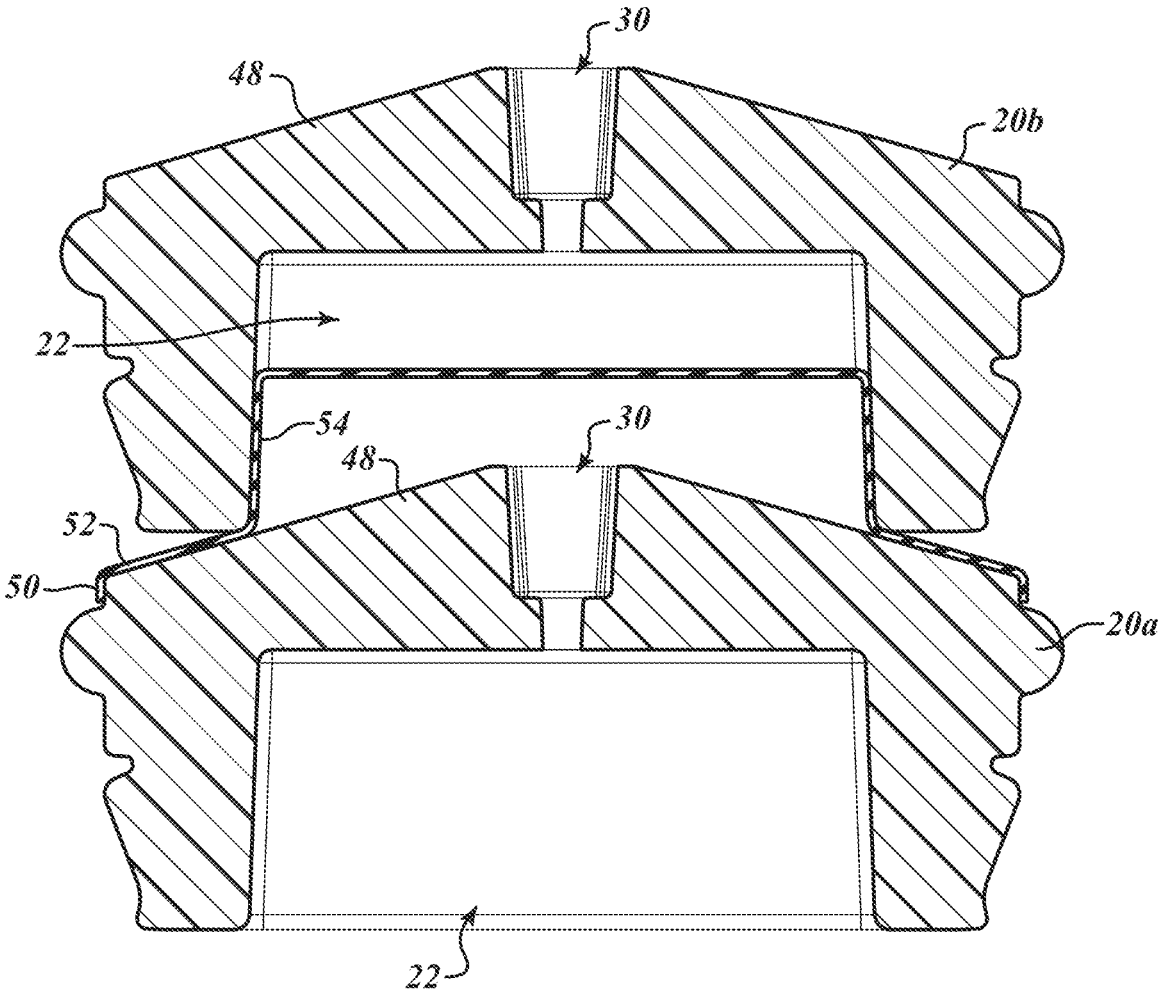
FIG. 4 is front cross-sectional view of the post cap of FIG. 1 shown stacked on another post cap of the same form.

With reference to FIGS. 3 and 4, the top side 32 of the post cap body 20 may be inclined downwardly away from a central apex 48 and, when a plurality of the post cap bodies 20 are stacked, the central apex 48 of a lower one 20*a* of adjacent stacked post cap bodies 20 may extend within the internal post cavity 22 of an upper one 22*b* of the adjacent stacked post cap bodies 20. In this manner, the post cap bodies 20 may nest together in a particularly efficient manner such that a plurality of stacked post cap bodies 20 can be stored or transported together with significant space savings.

With reference to FIG. 4, and according to one embodiment, a collection of post caps 20*a*, 20*b* may be provided wherein each post cap 20 has a single, unitary body with an internal post cavity 22 that is sized and shaped to receive an upper end 24 of a post 26 and which includes a tapered projection 48 extending from a top side 32 thereof. A liner 50 may be positioned between adjacent post caps 20*a*, 20*b*. The liner 50 may include a lower portion 52 configured to conceal an upper surface of a lower one 20*a* of the adjacent post caps 20*a*, 20*b* and an upper portion 54 configured to surround the tapered projection 48 of the lower one 20*a* of the adjacent post caps 20*a*, 20*b* and to prevent direct contact between the adjacent post caps 20*a*, 20*b*.

Figure 5:
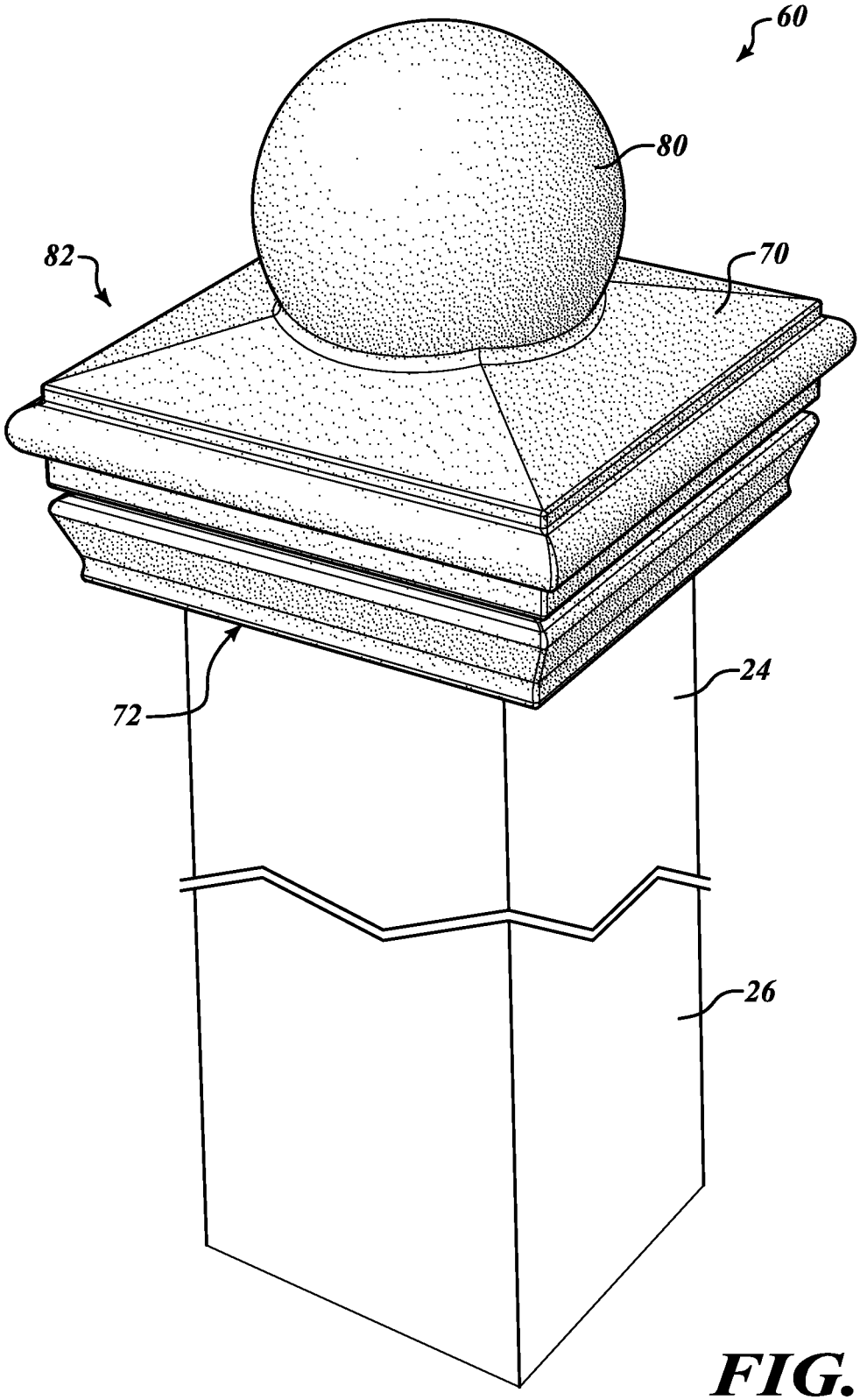
FIG. 5 is an isometric view of a post cap, according to another embodiment.
Figure 6:
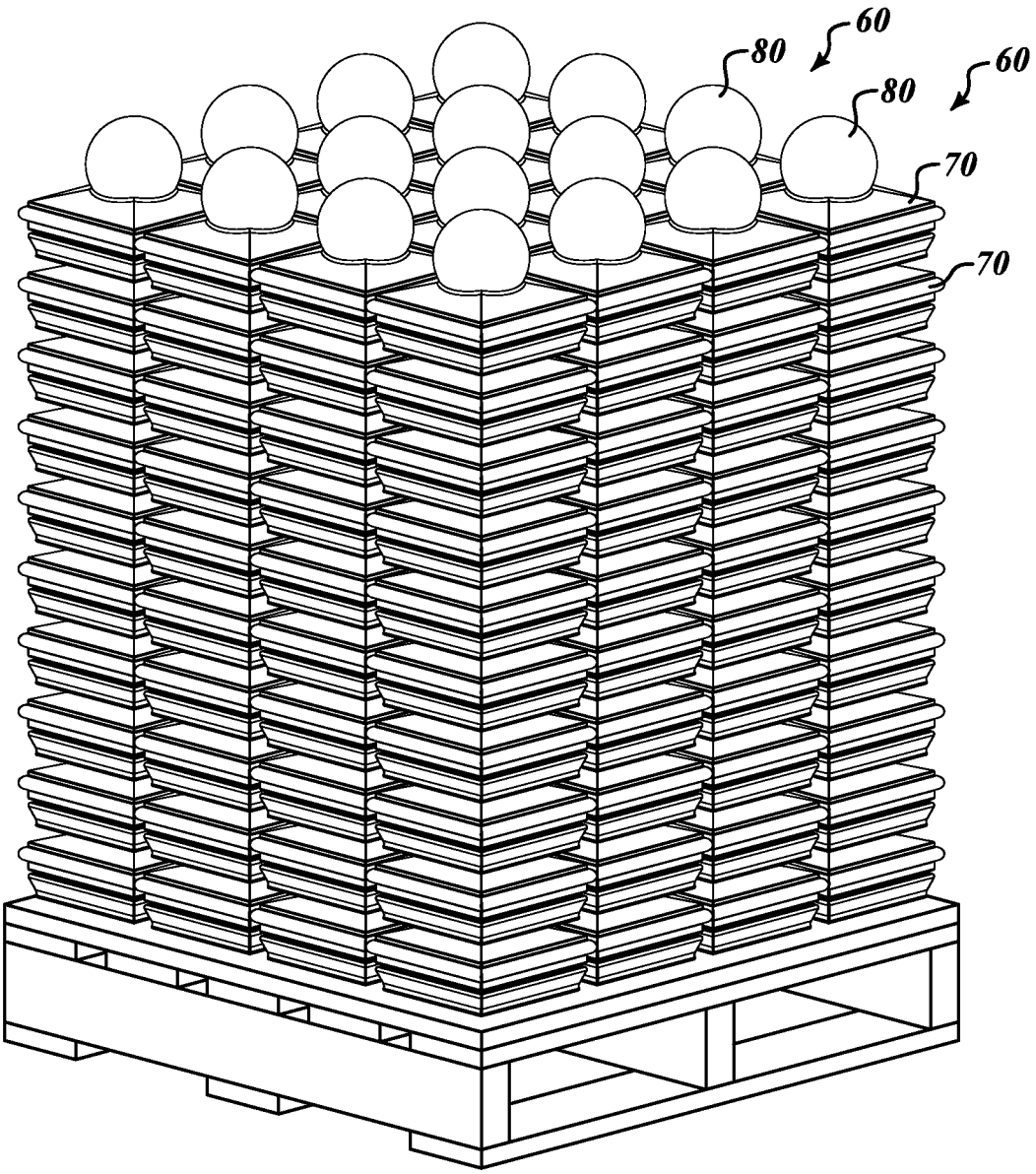
FIG. 6 is an isometric view of a plurality of the post caps of FIG. 5 stacked on a pallet for shipping or storage.
Figure 7:
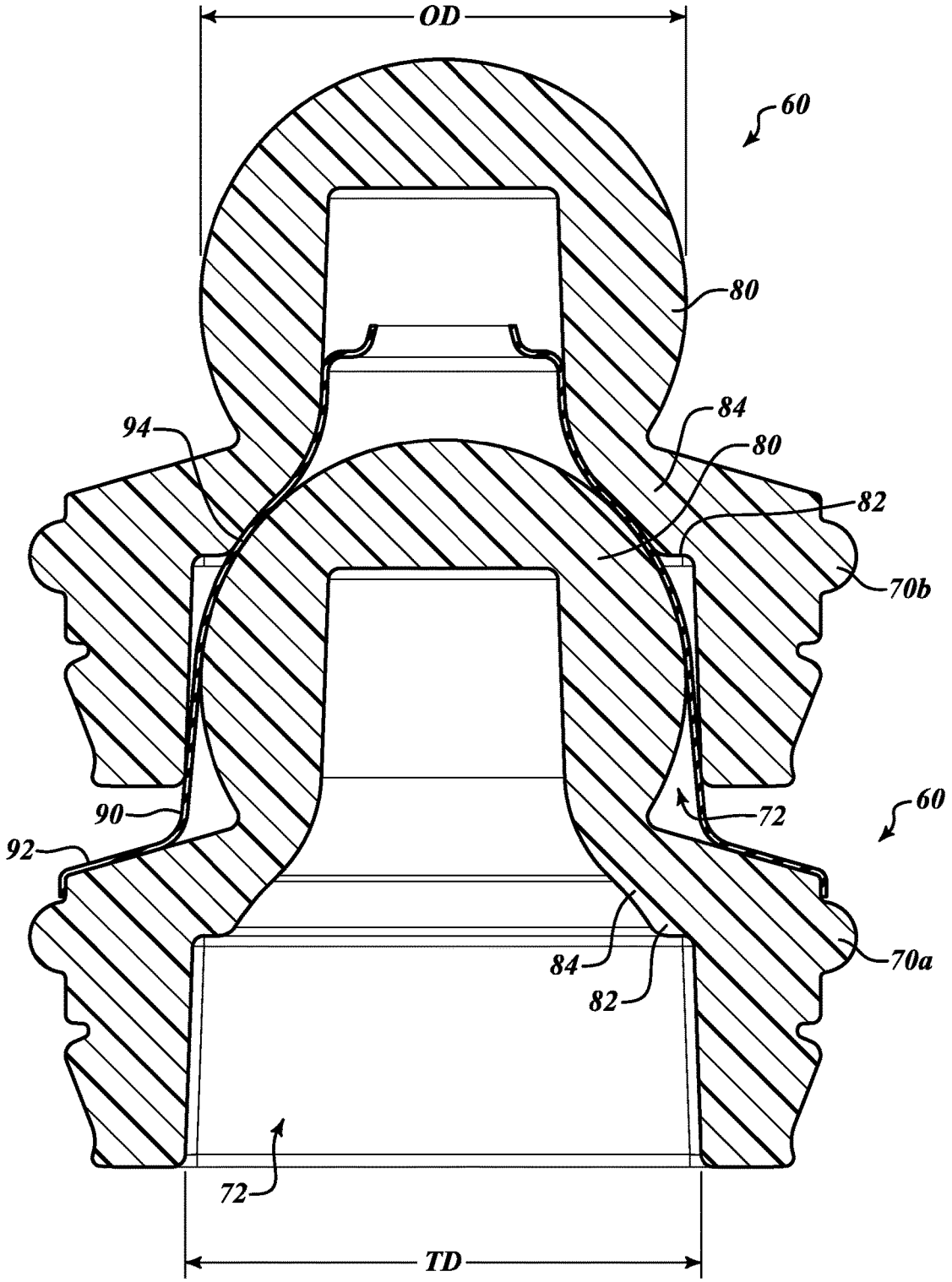
FIG. 7 is front cross-sectional view of the post cap of FIG. 5 shown stacked on another post cap of the same form.
Figure 8:
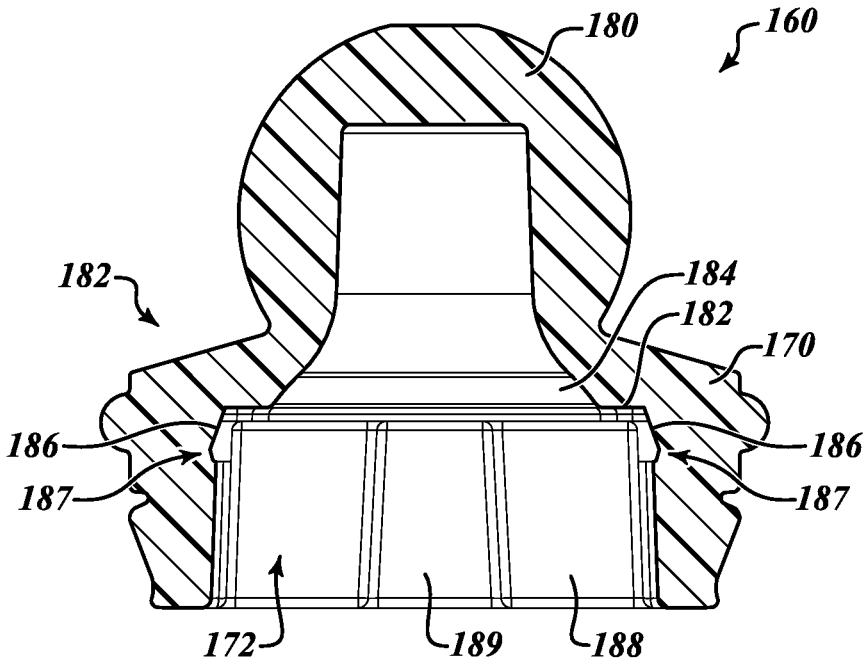
FIG. 8 is a front cross-sectional view of a post cap, according to another embodiment.
Figure 9:
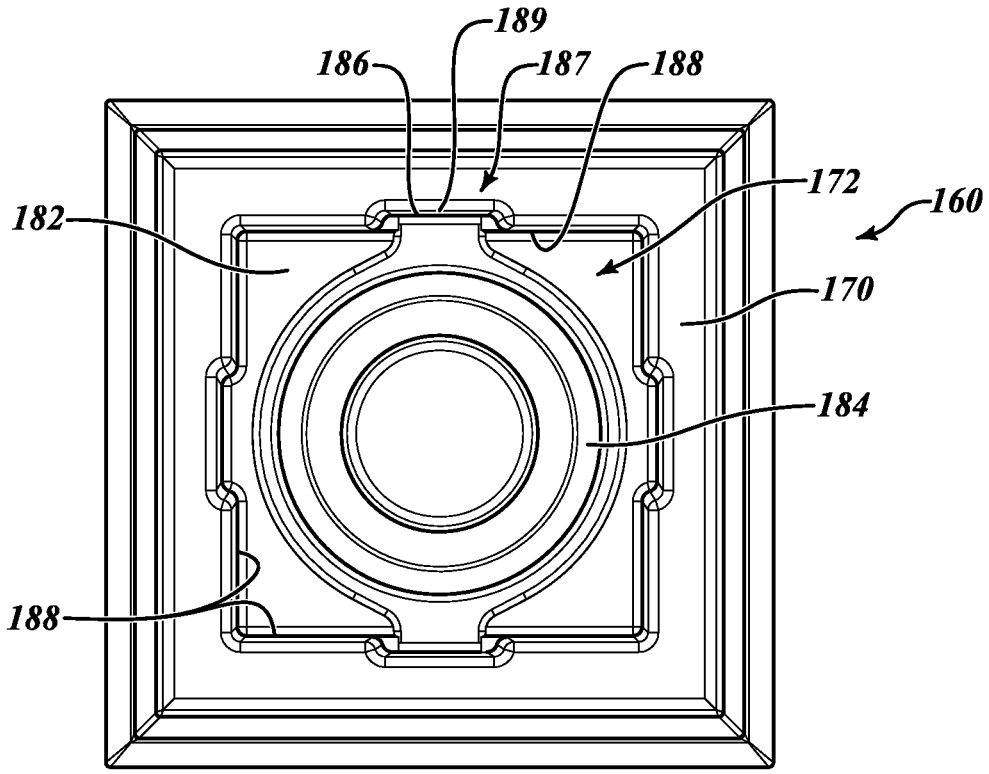
FIG. 9 is a bottom plan view of the post cap of FIG. 8.

FIGS. 5 through 7 illustrate another example embodiment of a post cap 60 that includes a robust form factor and which may be stacked in a particularly efficient manner. The post cap 60 may comprise or consist of a single, unitary body 70 having an internal post cavity 72 that is sized and shaped to receive an upper end 24 of a post 26. The unitary body 70 may further include a partially spherical projection 80 extending from a top side thereof 82. An outer maximum diameter OD (FIG. 7) of the partially spherical projection 80 may be less than a maximum transverse dimension TD (FIG. 7) of the internal post cavity 72 by no more than 0.50 inch, or in some instances, by no more than 0.25 inch.

The internal post cavity 72 may include a post receiving shoulder 82 and a nesting portion 84 adjacent thereto. The nesting portion 84 may be shaped to nest with the partially spherical projection 80 of an adjacent post cap 60 when the post cap 60 is stacked thereon and to assist in centering the post cap 60 on the adjacent post cap 60.

With reference to FIGS. 6 and 7, and according to one embodiment, an arrangement of post caps 60 may be provided which includes a plurality of stacked post caps 60, each post cap 60 having a single, unitary body 70 with an internal post cavity 72 that is sized and shaped to receive an upper end 24 of a post 26 and having a partially spherical projection 80 extending from a top side 82 thereof. The arrangement may further include a plurality of liners 90, with each liner 90 being positioned between a pair of adjacent post caps 60. Each liner 90 may include a lower portion 92 configured to conceal an upper surface of a lower one of the pair of adjacent post caps 60 and an upper portion 94 configured to surround the partially spherical projection 80 of the lower one of the pair of adjacent post caps 60 and to prevent direct contact between the pair of adjacent post caps 60.

FIGS. 8 through 12 illustrate another example embodiment of a post cap 160 that includes a robust form factor and which may be stacked in a particularly efficient manner, and which may operate with a separable post attachment device 200 for enabling efficient attachment of the post cap 160 to an upper end 124 of a post 126. The post cap 160 may comprise or consist of a single, unitary body 170 having an internal post cavity 172 that is sized and shaped to receive the upper end 124 of the post 126. The unitary body 170 may further include a partially spherical projection 180 extending from a top side 182 thereof or a wide variety of other regular or irregular shaped structures, such as, for example, an acorn shaped structure, extending from the top side 182.

Figure 11:
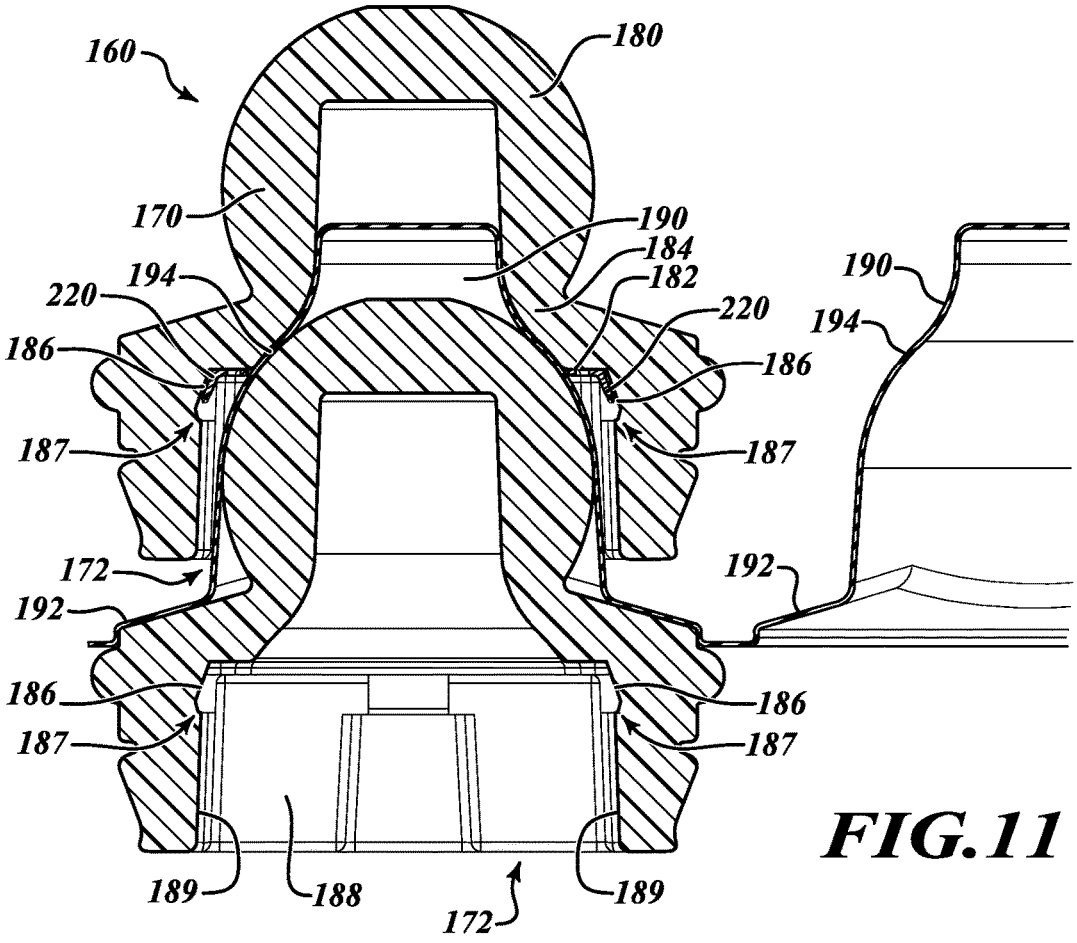
FIG. 11 is front cross-sectional view of the post cap of FIG. 8 shown stacked on another post cap of the same form.
Figure 12:
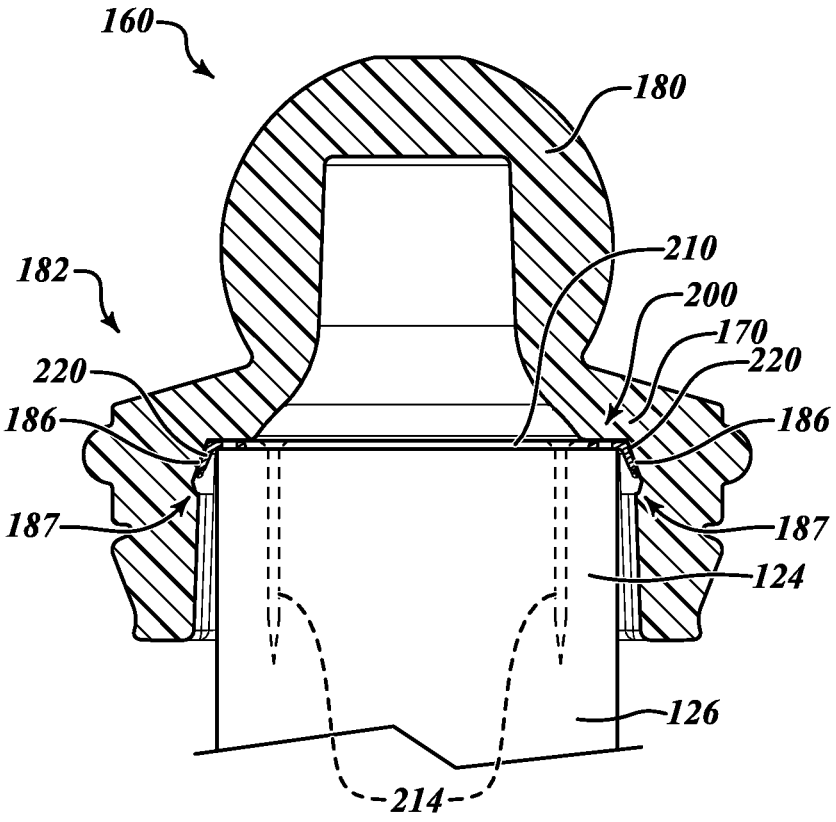
FIG. 12 is a front cross-sectional view of the post cap of FIG. 8 shown attached to an upper end of a fence post.

With reference to FIG. 11 in particular, the internal post cavity 172 may include a post receiving shoulder 182 and a nesting portion 184 adjacent thereto. The nesting portion 184 may be shaped to nest with the partially spherical projection 180 or other regular or irregular shaped projection of an adjacent post cap 160 when the post cap 160 is stacked thereon. The nesting portion 184 may also assist in centering the post cap 160 on the vertically adjacent post cap 160.

Figure 10:
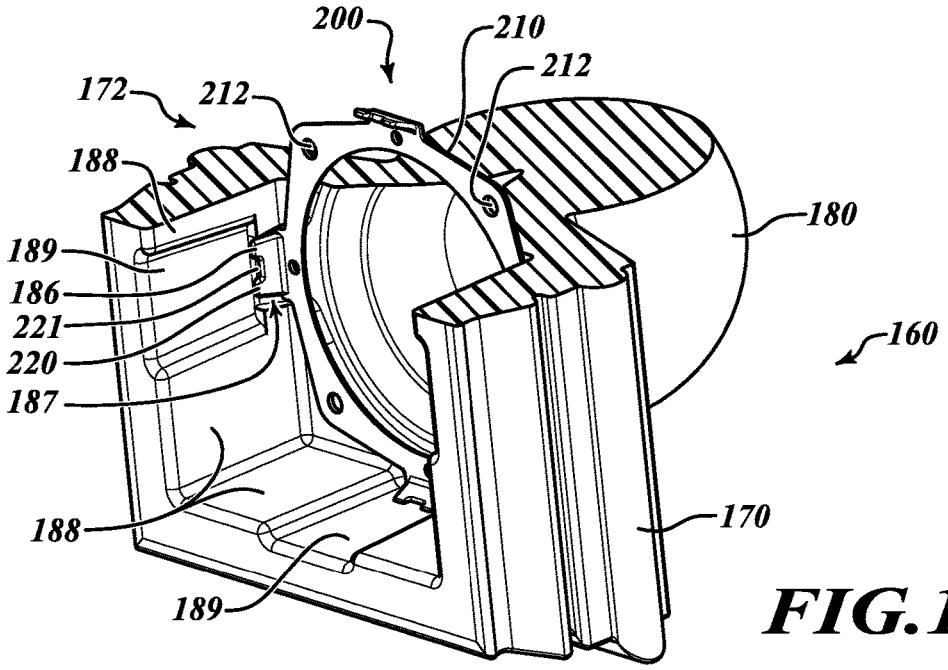
FIG. 10 is a skewed bottom view of the post cap of FIG. 8 with a portion of the post cap cut away to show details of a post attachment device received within the post cap.

As shown best in FIG. 10, the post attachment device 200 may include a generally planar body 210 with an array of apertures 212 provided therein to receive fasteners 214 (FIG. 12) for securing the post attachment device 200 to an end face of the upper end 124 of the post 126. The post attachment device 200 may further include a pair of opposing resilient coupling features 220 for removably engaging opposing portions 186 of the post cap body 170 within the internal post cavity 172. In this manner, the post attachment device 200 can be separated from the post cap body 170 for attachment to the upper end 124 of the post 126 apart from the post cap body 170. More particularly, the post cap body 170 may include opposing engagement cavities 187 each sized and shaped to receive a respective one of the resilient coupling features 220 of the post attachment device 200. In some instances, each resilient coupling feature 220 may comprise a resilient tab that is sized, shaped and positioned to snap into the respective engagement cavity 187 of the post cap body 170. Each resilient tab may also be sized, shaped and positioned to flex in response to contact with the sidewalls 188 of the post cap body 170 during insertion of the post attachment device 200 into the internal post cavity 172 of the post cap body 170.

In some embodiments, the post attachment device 200 is sized to be insertably received and press fit within the internal post cavity 172 of the post cap body 170. More particularly, the opposing resilient coupling features 220 may be urged inwardly by the sidewalls 188 of the post cap body 170 during insertion of the post attachment device 200 and then may spring back outwardly into the cavities 187 when reaching the position shown in FIGS. 10 through 12. One or more of the resilient coupling features 220 may include a notch 221 or other feature to assist in prying the post attachment device 200 out of engagement with the post cap body 170, and more particularly in prying the resilient coupling feature 220 out of the engagement cavity 187 in which it is received. The sidewalls 188 of the post cap body 170 may also include grooves 189 or other features to assist in receiving the post attachment device 200 and guiding the resilient coupling features 220 into proper engagement with the cavities 187. This may facilitate efficient coupling and de-coupling of the post attachment device 220 from the internal post cavity 172 of the post cap 160.

With reference to FIG. 11, and according to one embodiment, an arrangement of post caps 160 may be provided which includes a plurality of stacked post caps 160, each post cap 160 having a single, unitary body 170 with an internal post cavity 172 that is sized and shaped to receive an upper end 124 of a post 126 and having a partially spherical projection 180 or other regular or irregularly shaped projection extending from a top side 182 thereof. The arrangement may further include one or more liners 190 positioned between vertically adjacent post caps 160. The liner or liners 190 may include a lower portion 192 configured to conceal an upper surface of a lower one of the pair of vertically adjacent post caps 160 and an upper portion 194 configured to surround the partially spherical or other shaped projection 180 of the lower one of the pair of adjacent post caps 160 and to prevent direct contact between the pair of vertically adjacent post caps 160. As shown in FIG. 11, the post caps 160 may also be stacked together with a post attachment device 220 installed within the internal post cavity 172 of the post cap body 170. The post attachment device 220 installed within the internal post cavity 172 of the post cap body 170 to nest closely therewith so as to not interfere with the stacking of the post caps 160. In this manner, each post cap 160 may be provided with means for securely attaching the post cap 160 to a post and may be stacked in a particularly space efficient manner for storage and transport.

To adorn posts 126 (e.g., fence posts) with such post caps 160, a user can simply pry out or otherwise remove the post attachment device 220 from within the internal post cavity 172, attach the post attachment device 220 to the upper end 124 of the post 126 with nails or other conventional fasteners 214 (FIG. 12), and then snap the post cap 160 onto the upper end 124 of the post 126 until the resilient coupling features 220 of the post attachment device engage the respective engagement cavities 187 formed in the post cap body 170. Advantageously, the caps 160 can be securely attached to posts 126 quickly and efficiently and with no fasteners being externally visible to those viewing the capped posts. As can also be appreciated from FIGS. 8 through 12, each post cap 160 may provide a unitary body 170 that completely conceals the upper end 124 of the post 126 and may lack any seams, gaps or other areas in which rain water could otherwise infiltrate the cap and deteriorate the upper end 124 of the post 126.

Figure 13:
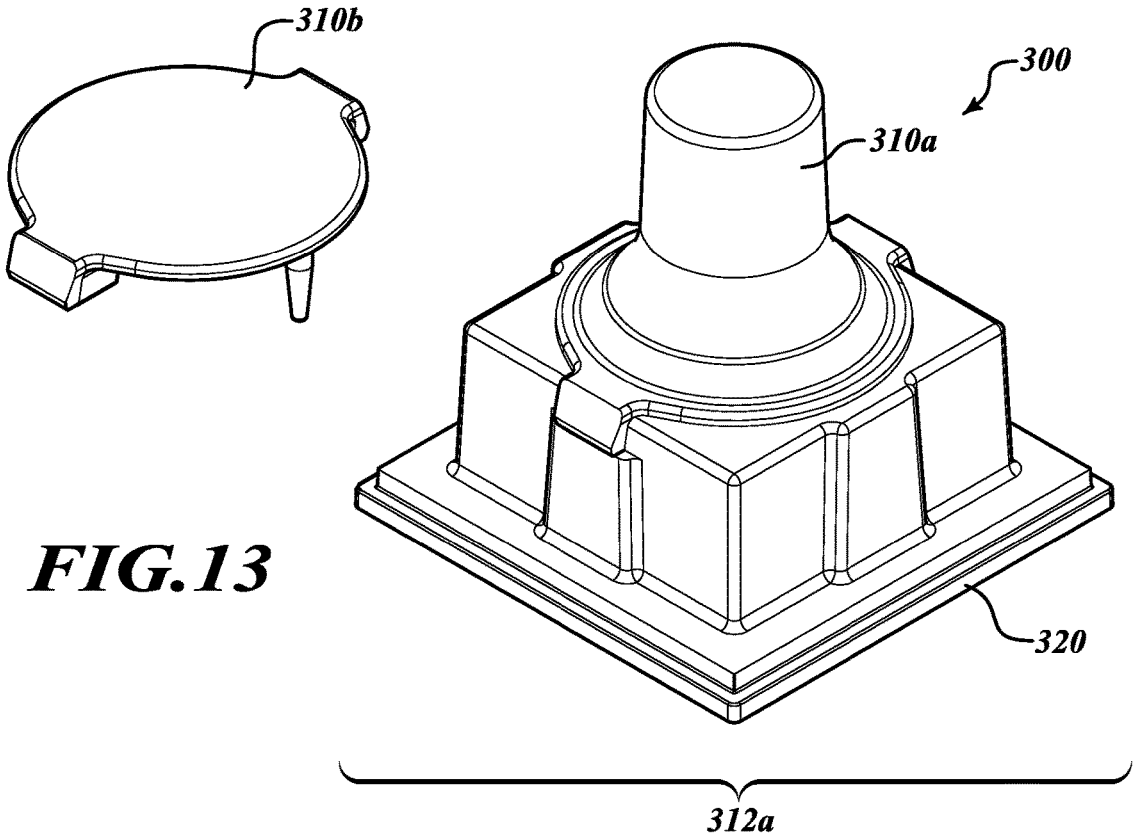
FIG. 13 is an isometric view of a multi-piece mold core kit for forming post caps, according to one embodiment.
Figure 14:
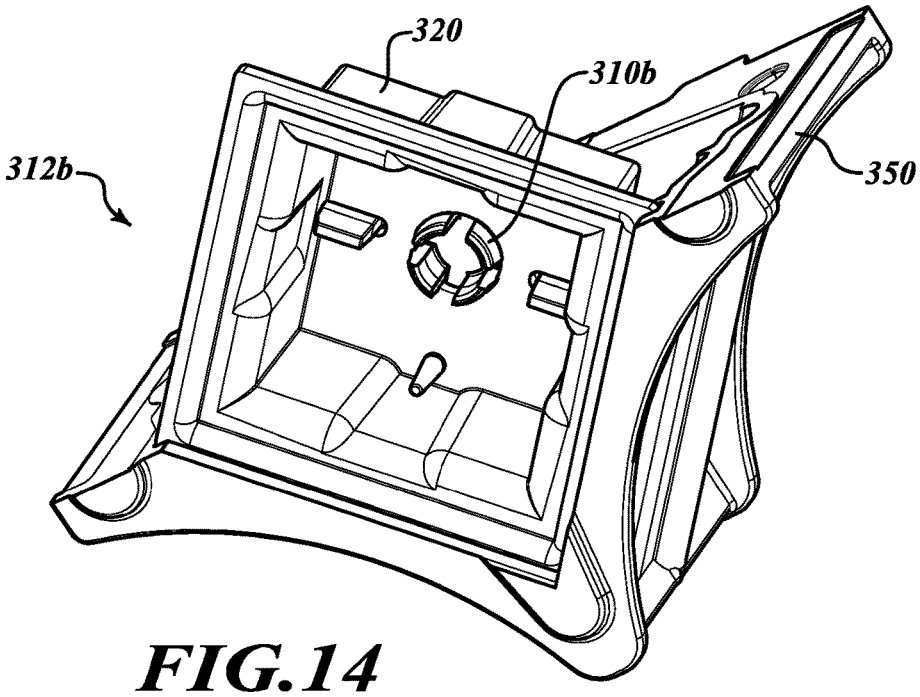
FIG. 14 is a skewed bottom view of one combination of the multi-piece mold core received in one half of an outer mold form used to fabricate post caps, according to one embodiment.

FIG. 13 shows a multi-piece mold core kit 300 for forming post caps 10, 60, 160 according to one or more embodiments described herein, and FIG. 14 shows one combination 312*b* of the multi-piece mold core kit received in one half of an outer mold form 350 used to fabricate post caps 10, 60, 160. As can be appreciated from FIG. 13, the multi-piece mold core kit 300 may include a plurality of core tops 310*a*, 310*b* that are interchangeably coupleable to a core base 320 to fabricate post caps 10, 60, 160 having different configurations. For example, the core top 310*a* may be coupled to the core base 320 and then used to mold caps 160 having the form shown in FIGS. 8 through 12. As such, the assembled mold core 312*a* may have external surfaces that are identical to the internal surfaces of the formed caps 160. As can be appreciated from FIG. 14, an assembled mold core 312*b* may be enclosed within an outer mold form 350 for molding post caps. The outer mold form 350 may comprise two identical mold halves (one shown).

Although only several different shaped post caps 10, 60, 160 are shown in the accompanying drawings, it is appreciated that post caps may be formed to include a wide variety of different aesthetic shapes and may be provided in a wide variety of sizes to fit many different sized posts. In addition, although the post caps 10, 60 and 160 are show as including an internal post cavity having a generally rectangular cross-section, it is appreciated that in some embodiments post caps may be provided with an internal post cavity having other regular or non-regular shaped cross-sections, such as, for example, a circular cross-section for receiving cylindrical posts.

Moreover, aspects and features and the various embodiments described above can be combined to provide further embodiments. In addition, U.S. Provisional No. 61/868,026, filed Aug. 20, 2013, is incorporated herein by reference for all purposes and aspects of the present invention can be modified, if necessary, to employ features, systems, and concepts disclosed in this application to provide yet further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A post cap assembly for covering an upper end of a post, the post cap assembly comprising:

a post cap body having an internal post cavity that is sized and shaped to receive the upper end of the post and having rigid sidewalls with a plurality of grooves and engagement cavities formed in the rigid sidewalls, each groove extending from a lower end of the post cap body to a respective one of the engagement cavities; and a post attachment device having a planar body with an array of apertures for securing the post attachment device directly to an end face of the upper end of the post with a plurality of fasteners extending through the apertures, and having a respective resilient coupling feature at each of opposing sides of the post attachment device that is removably engaged with a respective one of the engagement cavities formed in the post cap body, the post attachment device being separable from the post cap body for direct attachment to the end face of the upper end of the post apart from the post cap body, wherein the post attachment device is configured to be completely concealed within the post cap body when the post cap body is attached to the upper end of the post via the post attachment device, and wherein each groove formed in the rigid sidewalls of the post cap body is configured to assist in guiding the respective resilient coupling feature of the post attachment device into engagement with the respective one of the engagement cavities.

2. The post cap assembly of claim 1, further comprising:

an interchangeable topper coupled to the post cap body, and wherein the interchangeable topper includes a decorative topper element that is configured to engage a topper receiving aperture of the post cap body with a snap fit or interference fit.

3. The post cap assembly of claim 1, further comprising:

an interchangeable topper coupled to the post cap body, and wherein the interchangeable topper includes a decorative topper element and a fastener to couple the interchangeable topper to the post cap body.

4. The post cap assembly of claim 3 wherein a threaded nut is concealed within the decorative topper element to receive the fastener.

5. The post cap assembly of claim 1, further comprising:

an interchangeable topper coupled to the post cap body, and wherein the interchangeable topper includes a decorative topper element having a skirt portion that is shaped to nest with a top side of the post cap body.

6. The post cap assembly of claim 5 wherein the skirt portion of the decorative topper element is configured to divert rain water away from a topper receiving aperture of the of the post cap body.

7. The post cap assembly of claim 1 wherein the post attachment device is sized to be insertably received and press fit within the internal post cavity of the post cap body.

8. The post cap assembly of claim 1 wherein each resilient coupling feature of the post attachment device comprises a resilient tab that is sized, shaped and positioned to flex in response to contact with a portion the rigid sidewalls of the post cap body within a region defined a respective one of the grooves during insertion of the post attachment device into the internal post cavity of the post cap body.

9. The post cap assembly of claim 1 wherein the post cap body is a single, one-piece body.

10. The post cap assembly of claim 1 wherein the post cap body is cast concrete or injection molded plastic.

11. The post cap assembly of claim 1 wherein a top side of the post cap body is inclined downwardly away from a central apex, and wherein, when a plurality of the post cap bodies are stacked, the central apex of a lower one of adjacent stacked post cap bodies extends within the internal post cavity of an upper one of the adjacent stacked post cap bodies.

12. The post cap assembly of claim 1 wherein a topper receiving aperture extends completely through the post cap body between the internal post cavity and a top side of the post cap body.

13. The post cap assembly of claim 1 wherein each resilient coupling feature of the post attachment device comprises a resilient tab that is sized, shaped and positioned to snap into the respective one of the engagement cavities of the post cap body when the post cap body is urged into engagement with the post attachment device.

14. A post cap assembly for covering an upper end of a post, the post cap assembly consisting of:

a single, unitary post cap body having an internal post cavity that is sized and shaped to receive the upper end of the post and having rigid sidewalls with a plurality of grooves and engagement cavities formed in the rigid sidewalls, each groove extending from a lower end of the post cap body to a respective one of the engagement cavities; and a post attachment device having a planar body with an array of apertures for securing the post attachment device directly to an end face of the upper end of the post with a plurality of fasteners extending through the apertures, and having a respective resilient coupling feature at each of opposing sides of the post attachment device that is removably engaged with a respective one of the engagement cavities formed in the post cap body, the post attachment device being separable from the post cap body for direct attachment to the end face of the upper end of the post apart from the post cap body, and wherein the post attachment device is configured to be completely concealed within the post cap body when the post cap body is attached to the upper end of the post via the post attachment device, and wherein each groove formed in the rigid sidewalls of the post cap body is configured to assist in guiding the respective resilient coupling feature of the post attachment device into engagement with the respective one of the engagement cavities.

* * * * *